US005478094A

United States Patent [19]

Pennestri

[11] Patent Number: 5,478,094

[45] Date of Patent: Dec. 26, 1995

[54] VARIABLE BRAKING SYSTEM

[76] Inventor: Scott A. Pennestri, 2637 Tennyson St., Thousand Oaks, Calif. 91360

[21] Appl. No.: 243,942

[22] Filed: May 17, 1994

[51] Int. Cl.[6] ..... A63C 17/14

[52] U.S. Cl. ..... 280/11.2; 280/11.22; 280/11.28

[58] Field of Search ..... 280/11.2, 11.22, 280/11.23, 11.28; 188/29, 1.12, 71.1, 74, 5

[56] References Cited

U.S. PATENT DOCUMENTS

| | | | |
|---|---|---|---|
| 1,603,588 | 10/1926 | Eberle | 280/7.13 |
| 3,339,936 | 9/1967 | Hamlin | 280/11.2 |
| 5,088,748 | 2/1992 | Koselka et al. | 280/11.22 |
| 5,118,122 | 6/1992 | Ricart | 280/11.2 |
| 5,135,244 | 8/1992 | Allison | 280/11.2 |
| 5,192,099 | 3/1993 | Riutta | 280/11.2 |
| 5,232,231 | 8/1993 | Carlsmith | 280/11.2 |
| 5,335,924 | 8/1994 | Richards, Sr. et al. | 280/11.2 |

FOREIGN PATENT DOCUMENTS

| | | | |
|---|---|---|---|
| 62701 | 10/1948 | Netherlands | 280/11.2 |
| 2160780 | 1/1986 | United Kingdom | 280/11.2 |

*Primary Examiner*—Margaret A. Focarino
*Assistant Examiner*—Carla Mattix
*Attorney, Agent, or Firm*—Terrance L. Siemens

[57] ABSTRACT

An in-line skate has a wheel mounted on a rocker arm so as to be pivotable toward and away from the main platform. The pivoting is restrained by a compression spring whose pre-load is adjustable with a screw arrangement. A fixed brake pad depends downwardly an adjustable distance from the main platform in the vicinity of the rocker arm mounted wheel. As the user tilts the platform the rocker arm and its associated wheel are pivoted toward the fixed brake pad. When the wheel contacts the brake pad, further tilting pressure arrests the wheel rotation and thus generates a frictional braking force between the wheel and the support surface.

3 Claims, 2 Drawing Sheets

VARIABLE BRAKING SYSTEM

BACKGROUND OF THE INVENTION

1. Field of the Invention

The present invention relates to roller skates or in-line skates known by the brand name "roller blades." More specifically, it relates to an improved in-line skate with a unique braking system. More generally, the principles of this invention can be used to arrest the forward momentum of any rolling load using only the weight of the load as a brake activating force. The fields of personal transportation and recreation are seen as the most likely benefactors from the advantages of the instant invention. The idea of using the weight of a rolling load to adjustably arrest the forward momentum of that load is applicable to any form of wheeled transport in use today.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Devices for enhancing personal mobility are old and well known in the art. Man has long attached wheels, blades, or runners to his feet so as to be able to roll or slide on the surface of a supporting terrain. Various forms of wheeled devices that permit travel over a ground surface are known. One class of such land vehicles includes roller skates, skateboards, scooters, and similar unpowered small vehicles which have a relatively small platform supported by wheels. The platform can be manipulated by the user in operating the device. A common problem with many of these devices is that it is difficult to stop one's forward momentum once it has been generated. This presents a rather serious safety hazard to the user and numerous injuries have occurred. Braking systems have not kept pace with the increased speed and utility of this class of vehicle. Recently, in-line skates have been developed which combine the advantages of ice blades with the ground traversing capabilities of roller skates by providing a series of in-line narrow wheels. In accordance with conventional terminology, the term in-line skate used herein may be taken to mean any non-powered vehicle having a series of in-line wheels supporting a platform or truck attachable to the feet of a user. The following known prior art has been directed to providing braking for this class of vehicle. As will be seen, the simplicity and effectiveness of my invention is not rivaled in the prior art.

U.S. Pat. No. 5,280,931, issued to Horton on Jan. 25, 1994, shows a roller brake for a vehicle such as an in-line skate. An auxiliary braking stop, resembling an eccentric wheel, is forced into contact with the ground by tilting the foot and exerting pressure on the heel. Since the braking foot must be tilted, it is virtually impossible to brake with both feet simultaneously. The patent shows no way of adjusting the heel pressure required to obtain braking. By contrast, the present invention requires no auxiliary ground engaging stop, is adjustable, and can easily brake both feet simultaneously.

U.S. Pat. No. 5,135,244, issued to Allison on Aug. 4, 1992, shows a leaf spring brake for a vehicle such as an in-line skate. By rocking the platform forward or backward, extending leaf springs can be brought into contact with the front or rear wheels, respectively. There is no adjustment shown. By contrast, the device of the instant invention provides adjustable braking force on a wheel which provides for different weight riders and different riding styles.

U.S. Pat. No. 5,067,736, issued to Olson et al. on Nov. 26, 1991, shows an external heel stop pad for an in-line skate. The patent requires the addition of the external pad and contemplates no sort of adjustable brake activation force. The wheels must be lifted from the ground to engage the stop pad and, consequently, simultaneous braking with both feet is impossible. By contrast, the device of the instant invention utilizes an existing wheel of the device to obtain the braking force and the adjustable brake activation force may be simultaneously applied to both feet.

U.S. Pat. No. 5,143,387, issued to Colla on Sep. 1, 1992, shows a toe actuated in-line skate brake assembly. No provision is made for adjustment of the brake activation force and there is a relatively complex mechanism required to convert the motion of the toes into actual brake pad pressure. In addition the braking force depends on a force other than the weight of the rider. By contrast, the braking device of the instant invention is adjustable for different riders and styles and does not require learning a new brake activation scheme or any complex mechanism. The present invention requires only the properly directed weight of the rider for activation of the brakes.

It will be noted that none of the prior art devices provide an adjustable brake activation force for matching different rider sizes and styles with an adequate wheel braking system.

None of the above inventions and patents, taken either singly or in combination, is seen to describe the instant invention as claimed.

SUMMARY OF THE INVENTION

Briefly, the invention comprises an in-line skate with a wheel mounted on a rocker arm so as to be pivotable toward and away from the main platform. The pivoting is restrained by a compression spring whose pre-load is adjustable with a screw arrangement. A fixed brake pad depends downwardly an adjustable distance from the main platform in the vicinity of the rocker arm mounted wheel. As the user tilts the platform the rocker arm and its associated wheel are pivoted toward the fixed brake pad. When the wheel contacts the brake pad, further tilting pressure arrests the wheel rotation and thus generates a frictional braking force between the wheel and the support surface.

Accordingly, it is a principal object of the invention to provide a new and improved variable braking device which overcomes the disadvantages of the prior art in a simple but effective manner.

It is a major object of this invention to provide a safety braking system for an in-line skate which is activated by bringing a downwardly extending brake pad into contact with the upper exterior surface of a ground engaging wheel.

It is another object of this invention to provide a safety braking system for an in-line skate which is adjustable for different rider weights and styles.

It is another object of this invention to provide a safety braking system for an in-line skate which is activated solely by the properly directed weight of the rider.

It is another object of this invention to provide a safety braking system for an in-line skate which is capable of braking with either foot alone or simultaneously braking both feet of the rider.

It is another object of the invention to provide a safety braking system for an in-line skate which is either adapted as a kit for retrofitting existing in-line skates or is capable of integration into a newly manufactured in-line skate.

It is another object of the invention to provide a safety braking system for an in-line skate which provides full maneuverability while braking.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
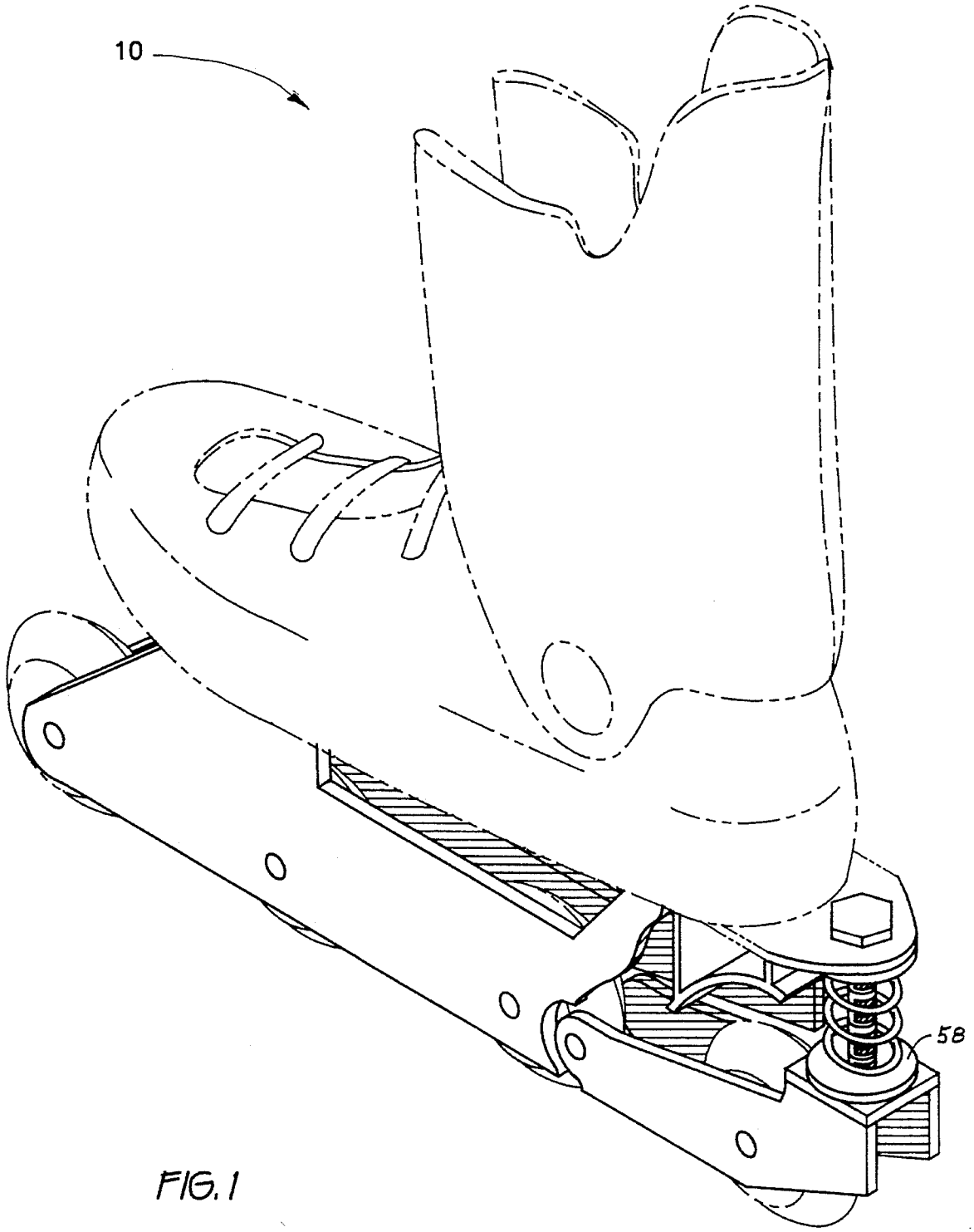
FIG. 1 is an exploded environmental perspective view of the invention.

The variable braking system of the present invention is generally designated by arrow 10 of FIG. 1. The device comprises the following main parts; foot attaching portion 20, main platform section 30, depending brake pad portion 41–43, and spring biased swing arm wheel assembly 50.

The foot attaching portion 20 (FIG. 2) of the in-line skate device of this invention is conventional and may comprise the common shoes, boots, straps, or clamps such as commonly found on roller skates, ice skates, and skis. This portion of the device requires no modification to utilize the principles of my invention. The usual standard shoe or boot top portion may be used, or the less common straps for surrounding existing shoes will serve just as well. Since the braking device of this invention is not dependent upon the particular type of foot attaching portion used, no further description will be given here.

Figure 2:
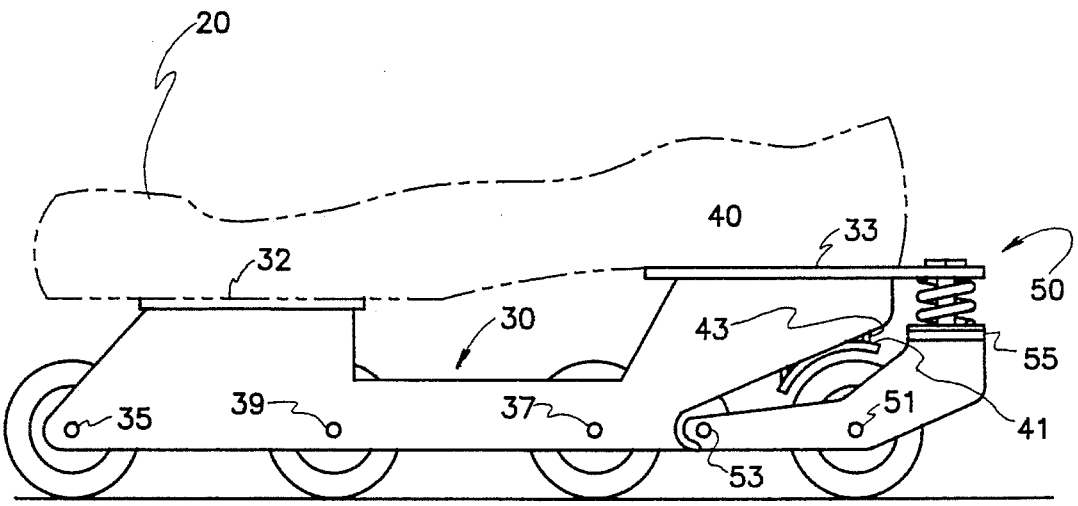
FIG. 2 is a side elevation view of the main undercarriage of an in-line skate in accordance with the invention.
Figure 3:
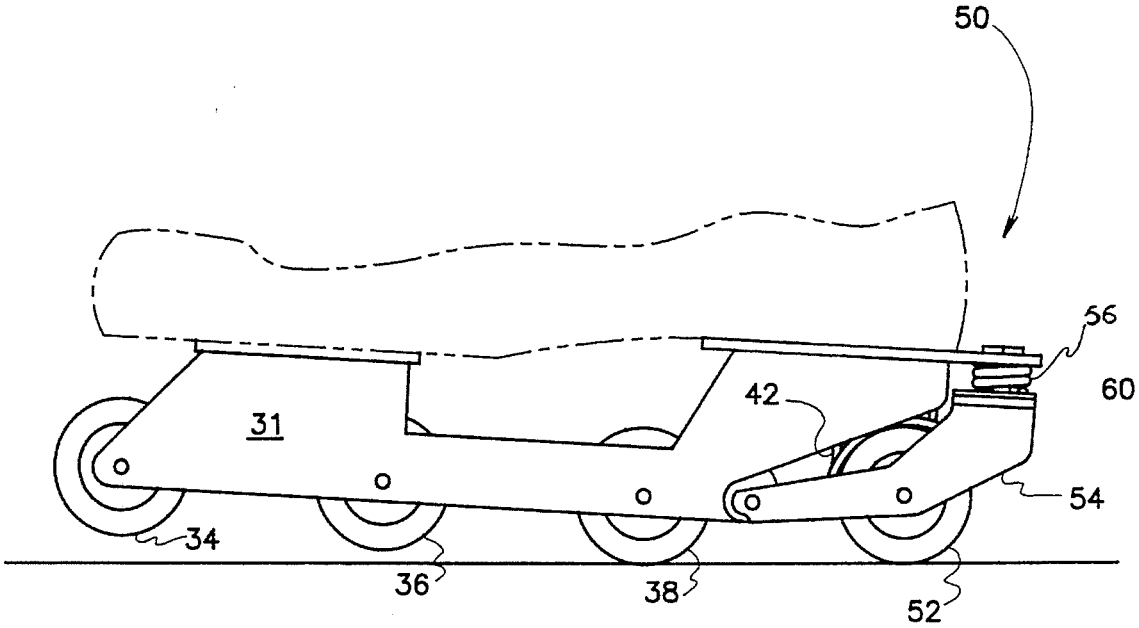
FIG. 3 is a side elevation view of the main undercarriage of an in-line skate in accordance with the invention with the brake shown in the applied position.

Turning to FIGS. 2 and 3, main platform portion 30 consists of two side frame members 31 supporting front and rear weight bearing platforms 32 and 33, respectively. Each side frame member is drilled with cross holes for axles 35, 37, and 39 for supporting forward in-line wheels 34, 36, and 38, respectively. In a typical in-line skate design the wheels would be single and centrally mounted on each axle. In a roller skate design there would be two side by side wheels on each axle and the wheels are usually wider. The wheels may be fitted with conventional bearings in a manner well known in the art so as to provide for free rotation. The exact number of forward wheels used is not critical to this invention and it is to be understood that three, two, or one single or sets of paired wheels could be used if desired.

Depending downward from a rear weight bearing platform 33 is a brake pad portion which is made up of adjustable support bracket with downwardly extending plates 42,43 holding brake plate 41 in position above rear wheel 52. Plates 42,43 may be joined together at their top sides (hidden from view) so as to form a sort of inverted U-shape with the base of the U-shape being screwed or otherwise affixed to the underside of platform 33. Shims could be inserted between the support bracket and platform 33 to adjust the distance of plate 41 from weight bearing platform 33. It is to be understood that this is but one of many possible means of mounting a surface, such as brake plate 41, an adjustable distance below another surface, such as weight bearing platform 33. For example, it is contemplated the brake pad portion could also be mounted from the side frame members 31 of the truck or main platform portion 30 if desired. Many variations will occur to the artisan and these are intended to be included in the scope of this invention as defined in the appended claims. Two main purposes of the adjustable brake plate 41 are to provide proper clearance for different sized wheels and to provide fine tuning for the necessary brake activation force discussed later. Plate 41 may be curved as shown to conform the surface of rear wheel 52 or it may be flat. The surface of brake plate 41 could obviously be covered with a replaceable wear pad (not shown) if desired. Since the wheels of in-line skates are usually themselves replaceable and made of a high friction producing material, it is contemplated there will not be a need for a replaceable wear pad.

The swing arm portion 50 of the variable braking system, forming the heart of the invention, will now be described. Swing arm 54 is pivotally mounted to main platform portion 30 at forward pivot 53. Rear wheel 52 is journalled to swing arm 54 at axle 51. The rear portion of swing arm 54 has a plate 55 disposed generally parallel to and underneath rear platform 33. Plate 55 is threaded so as to receive a bolt 57, the stem of which passes freely through a slot or oversized hole in rear platform 33. The far threaded end of bolt 57 is threaded to plate 55 at 60. Surrounding bolt 57 and compressed between platform 33 and plate 55 is a coil spring 56. It will be obvious that the pre-load on spring 56 can be adjusted by turning bolt 57. In another variation it is possible to adjust the spring pre-load by simply manually turning a threaded spring adjusting cup 58 as best seen in FIG. 1. Basically any form of adjustable suspension system, including torsion springs, may be used to mount swing arm 54 to the truck portion 30. As the pre-load is adjusted the distance between downwardly extending brake plate 41 and rear wheel 52 is reduced, thus making the overall braking action more sensitive. This adjustment, in combination with the vertical adjustment of brake plate 41 and the possibility of using a differing spring stiffness for spring 56, leads to virtually limitless adjustability of the braking characteristics of this novel in-line skate brake.

In use the rider can initiate braking of either or both rear wheels by exerting pressure on the heel portion of the in-line skate. This will compress spring 56 and pivot the swing plate counterclockwise as seen in the Figures. This, in turn, will bring the rear wheel 52 into contact with brake plate 41 and tend to stop its rotation. The braking force can thus be applied without removing the guiding wheels from the ground and without losing maneuverability. The only force necessary to initiate the braking action is the weight of the user. It is also easily possible to brake both skates at once by pressing downward with both heels.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily see that bolt 57 could be inverted and passed freely through plate 55 and be threaded to platform 33. The artisan could also readily recognize that the invention could be equally well applied to the front, rather than the rear, wheels of an in-line skate.

It is to be understood that the present invention is not limited to the sole embodiment described above, but encompasses any and all embodiments within the scope of the following claims:

I claim:

1. A variable braking system attached to an in-line skate having a plurality of equal sized in-line wheels normally rolling on a support surface and a primary weight support platform for attachment to a foot of a user comprising:

side frame members rigidly attached to and extending downwardly from each side of said weight support platform with each side frame member mounting one end of at least two forward wheel axles;

substantially rigid brake pad means rigidly mounted beneath said weight support platform and extending downwardly toward a rearmost one of said in-line wheels;

swing arm means comprising;

a swing arm with a leading and a trailing end, said swing arm pivoted at said leading end to said side frame members and mounting a wheel axle of said rearmost one of said in-line wheels at said trailing end;

spring means resiliently biasing said trailing end of said swing arm downwardly so that, when said resilient bias is overcome by a downward force exerted on said platform by the user, said swing arm is pivoted upwardly with respect to said side frame members bringing said rearmost wheel into contact with said brake pad means so as to arrest the rolling of said rearmost wheel and thereby retard forward motion of said weight support platform.

2. The variable braking system of claim 1 wherein said spring means has a pre-load pressure adjusted by manual adjustment means.

3. The variable braking system of claim 2 wherein said manual adjustment means comprises a bolt threaded to said swing arm and passing through said weight support platform, said bolt passing centrally through said spring means.

* * * * *